United States Patent [19]

Thomsen

[11] 3,954,343

[45] May 4, 1976

[54] PLASTIC LOOSELEAF BINDER RING ASSEMBLY

[76] Inventor: John Thomsen, 535 Roosevelt Ave., River Vale, N.J. 07675

[22] Filed: Dec. 24, 1974

[21] Appl. No.: 536,206

[52] U.S. Cl. ..... 402/41; 402/20

[51] Int. Cl.[2] ..... B42F 3/04

[58] Field of Search ..... 402/26, 29, 30, 31, 402/36, 38, 41, 42, 20, 21, 22, 23

[56] References Cited

UNITED STATES PATENTS

| | | | |
|---|---|---|---|
| 793,370 | 6/1905 | Gresham | 402/29 |
| 924,647 | 6/1909 | Eddy | 402/41 |
| 1,439,367 | 12/1922 | Krag | 402/41 |
| 2,024,461 | 12/1935 | Lotter | 402/26 |
| 2,439,675 | 4/1948 | Segal | 402/38 |
| 2,511,153 | 6/1950 | Emmer | 402/41 X |
| 3,105,494 | 10/1963 | Duncan | 402/36 |
| 3,153,417 | 10/1964 | Newman | 402/41 |
| 3,205,895 | 9/1965 | Johnson | 402/38 |
| 3,313,304 | 4/1967 | Beyer | 402/22 |
| 3,383,786 | 5/1968 | McIntosh | 402/22 X |

*Primary Examiner*—Jerome Schnall

[57] ABSTRACT

The looseleaf binder ring assembly disclosed herein consists of a one-piece backbone formed of a resilient plastic material, which backbone has a plurality of pairs of cooperating fingers formed thereon. The fingers of each pair face one another and are movable between open and closed positions with respect to each other. A slidably mounted actuator bar is provided in the backbone and has cam surfaces formed thereon for respectively opening and closing the fingers when the slide bar is moved between first and second positions. The cam surfaces respectively hold their associated spring fingers in their opened or closed position in accordance with the position of the slide bar.

7 Claims, 6 Drawing Figures

PLASTIC LOOSELEAF BINDER RING ASSEMBLY

The present invention relates to looseleaf binder ring assemblies and, more particularly, to a two-piece looseleaf binder ring assembly which is formed entirely of plastic material.

Looseleaf binder rings and binder assemblies are formed in a variety of configurations; the most typical being the conventional metal binder ring assembly utilizing spring and cam mechanisms for holding the metal rings in their opened and closed positions. Such assemblies are relatively complex to manufacture and therefore are relatively expensive. Although some plastic binder ring assemblies have been previously proposed, these have not been entirely satisfactory in use since they typically require the user to manually bend the backbone of the assembly or operate some separate lever or slide mechanism for bending the backbone of the assembly in order to open and close the rings. Thus they do not operate in the same manner as the conventional metal binder assemblies. Moreover, they are relatively difficult to operate and typically cannot be mounted in a conventional looseleaf binder in the same manner that conventional metal binder ring assemblies are mounted. Thus they cannot be used as direct substitutes for the more expensive metal binder ring assemblies.

Accordingly, it is an object of the present invention to provide a looseleaf binder ring assembly formed of a plastic material which can be substituted for and used in place of conventional metal binder ring assemblies.

Another object of the present invention is to provide a looseleaf binder ring assembly which appears to operate in substantially the same manner as the conventional metal binder ring assemblies.

A further object of the present invention is to provide a looseleaf binder assembly which is relatively simple in construction and inexpensive to manufacture.

A still further object of the present invention is to provide a looseleaf binder assembly which is durable in use and simple to operate.

In accordance with an aspect of the present invention a looseleaf binder ring assembly is provided which includes a one-piece backbone formed of a resilient plastic material and having a generally inverted U-shaped configuration in section. The backbone has a bight portion which defines upper and lower surfaces and has a plurality of apertures formed therein with a plurality of pairs of cooperating fingers formed integrally therewith and extending through the apertures. The fingers of each pair face one another and are pivotally connected to the backbone by integral flexible webs so that the fingers are adapted to be moved between opened and closed positions with respect to each other. These fingers have upper looseleaf holding portions which extend from their respective openings above the upper surface of the backbone and also have lower end portions which extend through the openings to positions below the lower surface of the backbone.

A slide bar is slidably mounted for movement between first and second positions with respect to the backbone, which positions correspond respectively to the opened and closed positions of the fingers. The slide bar has a plurality of finger moving members formed integrally therewith and respectively associated with the lower end of each of the fingers. These finger moving members each has an upwardly opening recess formed therein and a generally diagonally opposed pair of cam surfaces on opposite sides thereof. These cam surfaces extend angularly with respect to the direction of sliding movement of the bar and the lower end portions of the fingers are received therebetween in the recesses of the finger moving members. The cam surfaces respectively engage the lower end portions of the looseleaf binder fingers associated therewith in the first and second positions of the slide bar. Thus, one of the cam surfaces engages its associated finger and holds it in its open position when the slide bar is in its first position and the other of the cam surfaces engages its associated finger and holds it in its closed position when the slide bar is in its second position. The cam surfaces which hold the fingers in their closed positions have locking surface portions which serve to effectively lock the fingers in their closed position against inadvertent opening thereof during use of the binder assembly.

The above, and other objects, features and advantages of this invention, will be apparent in the following detailed description of an illustrative embodiment thereof, which is to be read in connection with the accompanying drawings wherein.

Figures 1, 2:
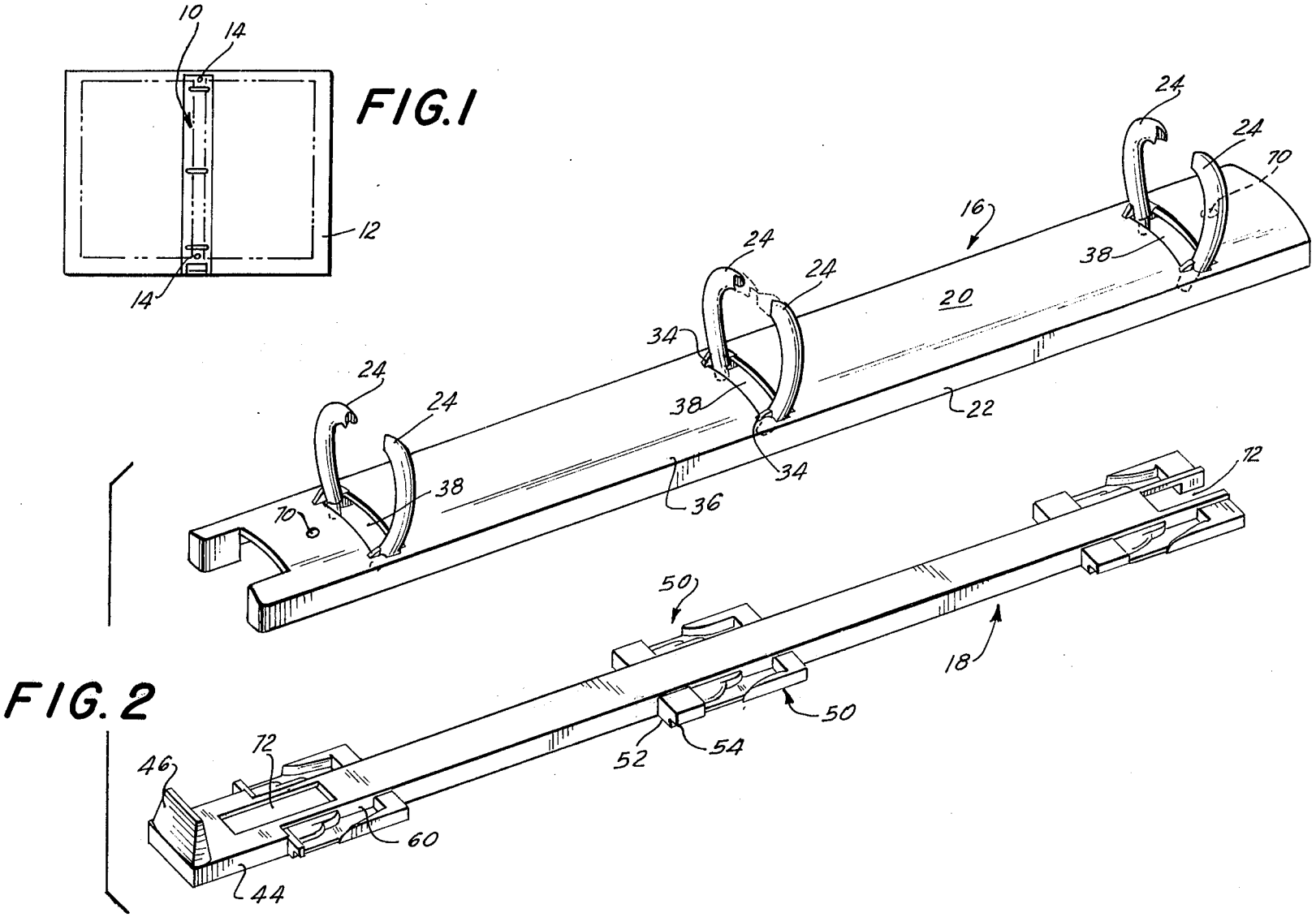
FIG. 1 is a plan view of a looseleaf binder having a binder ring assembly constructed in accordance with the present invention mounted therein.
FIG. 2 is an enlarged perspective view of the binder ring assembly of the present invention.

Referring now to the drawing in detail and initially to FIG. 1 thereof, it will be seen that a binder ring assembly 10, constructed in accordance with the present invention is adapted to be mounted in a conventional binder 12 for holding looseleaf pages. The binder ring assembly 10 is mounted in binder 12 by a pair of rivets 14 or the like, as described hereinafter, in the same manner that conventional metal binder ring assemblies are mounted. Thus, the manufacturer of looseleaf binders need not modify his assembly equipment in order to utilize the two-piece plastic binder ring assembly of the present invention in the manufacture of conventional looseleaf binders.

As seen in FIG. 2, the looseleaf binder ring assembly 10 of the present invention consists of two elements, namely a backbone 16 and an actuator or slide bar 18. Backbone 16 is an elongated generally rectangularly shaped member having a generally U-shaped configuration in section (see FIG. 4) and includes a bight portion 20 and a pair of depending legs 22. A plurality of pairs of fingers 24 are integrally formed with the backbone 20 and are moved by the slide bar 18 between opened and closed positions to allow insertion or removal of looseleaf pages from the assembly. The number of pairs of fingers 24 provided along backbone 16 depends of course upon the type of looseleaf pages to be mounted in the binder, i.e. two, three or four ring pages, etc. In the illustrative embodiment of the invention a three ring binder assembly is shown having three pairs of ring fingers 24.

Figure 4:
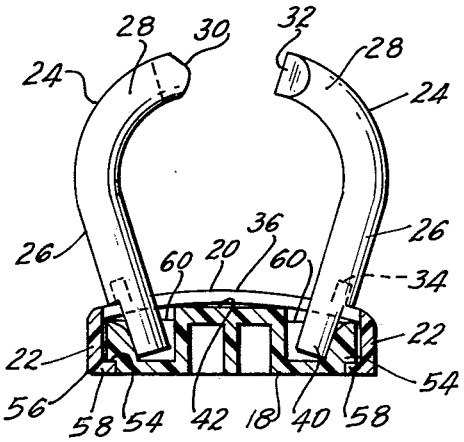
FIG. 4 is a sectional view taken along line 4—4 of FIG. 3.
Figure 6:
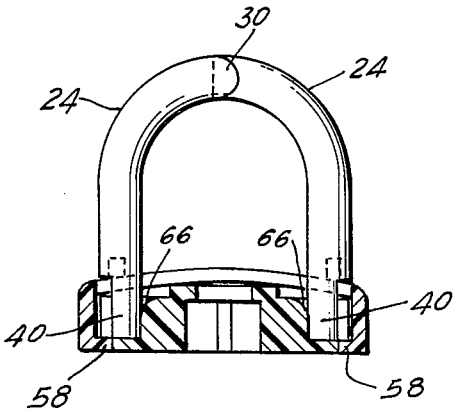
FIG. 6 is a sectional view taken along line 6—6 of FIG. 5.

As seen most clearly in FIGS. 4 and 6, the ring fingers 24 have straight portions 26 and curved upper edge portions 28 which are mitered in the conventional manner at their free ends 30, 32 respectively, so that they join in the closed position of the fingers (FIG. 6) to form a complete enclosure for holding the looseleaf pages.

Each of the ring fingers 24 is flexibly connected to the backbone 16 by integral webs 34 formed on opposite sides thereof, which webs secure the fingers to the upper surface 36 of the bight portion of backbone 16. In this connection, an opening 38 is formed in the bight portion 20 of backbone 16 at each pair of ring fingers 24 so that, although the fingers are integrally formed with the backbone, the only connection between the fingers and the backbone are the thin webs 34 which provide a pivotal mounting for the fingers on the backbone. Referring to FIG. 4, it is seen that the lower end portions 40 of each of the spring fingers extend below the lower surface 42 of the backbone bight portion 20, to positions between the side legs 22 thereof. These lower ends of the ring fingers are engaged by the slide bar 18, as described hereinafter, in order to move the fingers between their opened and closed positions.

Figure 5:
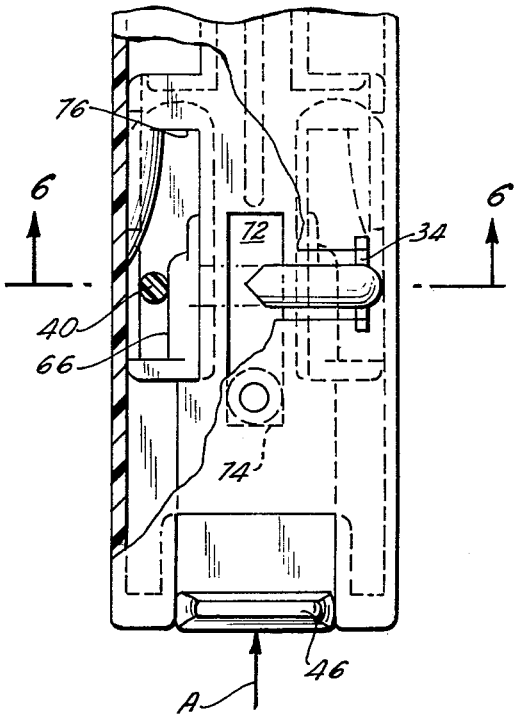
FIG. 5 is a plan view, with parts broken away, similar to FIG. 3, showing the configuration of the binder ring assembly elements in the closed position of the ring fingers.

Slide bar 18 consists of a generally elongated rectangular member whose length is substantially equal to the length of the backbone 16. One end 44 of the slide bar is a finger engaging extension 46 by which the user can slide the bar between first and second positions to open and close the ring fingers. As seen in FIG. 5, the bight portion 20 of backbone 16 has a recess or notch 48 formed therein which will accommodate the extension 46 to provide a compact arrangement when the ring fingers are in their closed position.

Slide bar 18 has identically formed finger moving members or elements 50 formed in pairs on opposite sides thereof along the length of the bar, which elements respectively cooperate with the lower ends 40 of the ring fingers 24 in order to open and close the fingers. The lower surfaces 52 of each of these elements has an elongated recess or step 54 formed therein by which the slide bar 18 is slidably mounted and retained within the backbone 16. As seen in FIGS. 4 and 6, the lower end portions 56 of the backbone sidewalls 22 have inwardly extending flanges 58 formed thereon, which fingers may extend along the entire length of the backbone, or which can be formed as separate segments (see FIG. 3) respectively associated with each of the finger moving members 50. In either case, the slide bar is retained on these flanges within the backbone and the bar can slide within the backbone between the two positions thereof illustrated respectively in FIGS. 3 and 5.

Figure 3:
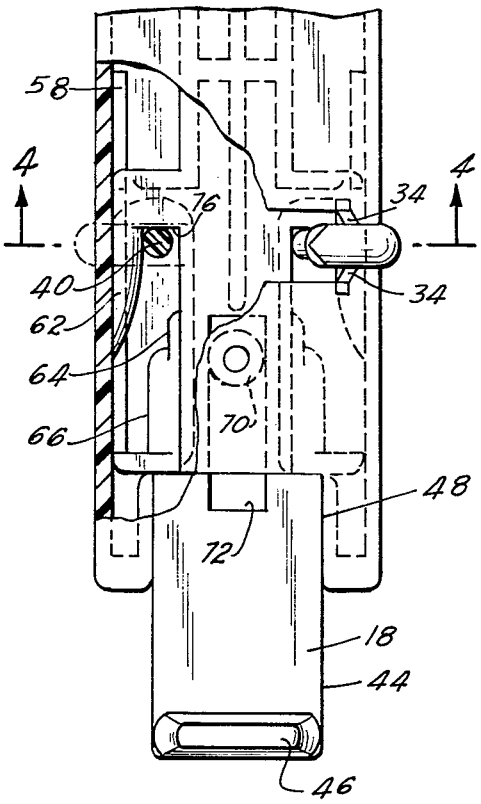
FIG. 3 is a partial plan view, with parts broken away, of the binder ring assembly shown in FIG. 2, with the ring fingers in their open position.

Since each of the moving members 50 is of identical construction, only one pair of these members need be described in detail. Thus, for illustrative purposes, only the moving members 50 adjacent the finger engaging extension 46 of the binding assembly is illustrated in FIGS. 3 and 5. As seen therein each of these members has a recess or well 60 in which the lower end portion 40 of the ring fingers 24 are located. This recess is bounded on diagonally opposed sides by a pair of cam surfaces 62, 64. In the open position of the fingers 24, the cam surfaces 62 engages the finger portion 40 to pivot the finger on the webs 34 to its outer or opened position. When the slide bar 18 is moved inwardly from the position shown in FIG. 3 to the position shown in FIG. 5, the lower end portions 40 of the ring fingers are engaged with the cam surfaces 64. These cam surfaces may have the same configuration, such as for example the continuously sloped configuration of the cam surface 62, however it is preferred that the cam surface 64 include a flat section 66, so that in the closed position of the ring fingers 24 the cam surfaces bias the fingers towards each other and lock the fingers in the closed position. If the cam surface at this point were inclined with respect to the direction of sliding movement (arrow A in FIG. 5), the resiliency of the plastic material from which the fingers 24 are formed may tend to urge the slide outwardly in a direction opposite to the direction of the arrow A allowing the fingers 24 to open. Thus, by providing the flat surface 66 parallel to the direction of movement A, the fingers are locked in position until the slide 46 is purposely moved by the operator in a direction opposite to that of the arrow A.

The backbone 16 and slide bar 18 are both formed from injection molded plastic material such as for example polypropylene. When the backbone is molded, the ring fingers 24 are formed with their end portions 28 adjacent each other in substantially the closed position (as seen in FIG. 2 in dotted lines). However, because of the plastic memory of the material, after the backbone and slide bar are assembled and the fingers opened by operation of the slide bar, the material will tend to keep the ends 28 of the fingers slightly spaced from one another, as seen in FIG. 2 in solid lines, wherein the fingers are neither in their opened nor their closed positions. Thus it is important that the finger moving members 50 have cam surfaces which will urge the fingers in the appropriate direction depending upon the position to which the slide bar 46 is moved. In this manner the fingers 24 are fully controlled and held in their opened or closed positions as selected by the user.

In order to mount the binder assembly 10 in the binding 12, the backbone 16 is provided with a pair of mounting posts 70 which are of generally cylindrical construction and extend downwardly from the lower surface 42 of the backbone bight portion 20. These posts extend through slots 72 formed in the slide bar 18 so that the posts do not interfere with sliding movement of the slide bar between its two positions illustrated respectively in FIGS. 3 and 5. These posts serve to guide the rivets 14 which secure the assembly to the binder 12 in the same manner that the rivets used with conventional metal looseleaf binders secure the metal binder ring assembly to the binder itself.

The slots 72 can also serve to limit or define the first and second positions of the slide bar 18 at which the ring fingers 24 are opened or closed. Thus for example, it is seen in FIG. 5, the slot 72 can be dimensioned so that its edge 74 will engage the post 70 to limit inward movement of the slide bar 18 in the direction A. At that position the lower end portions 40 of the fingers 24 engage the flat surface section 66 of the cam surface 64 to lock the fingers in their closed positions. Likewise, the other end portion of the slot 72 can be used to limit or define the other position of the slide bar at which the fingers are opened. Alternatively, the finger moving members 50 can be provided with shoulder portions, such as for example the shoulder 76 adjacent the cam surface 62, which will engage the lower end portions 40 of the spring fingers to limit outward movement of the slide bar 18 in a direction opposite to that of the arrow A in FIGS. 3 and 5.

Accordingly, it will be seen that in order to operate the binder ring assembly 10 of the present invention slide bar 18 is simply moved to one of its two limited positions. For example, when it is desired to open the binder ring assembly, which is in its closed position in FIG. 5, the slide bar 18 is moved outwardly, in a direction opposite to that indicated by the arrow A in FIG. 5, simply by pulling on the extension 46. This disengages the ends 40 of the fingers from the cam surfaces 64, 66 and moves the cam surface 62 into engagement therewith. The sliding movement of the bar moves the cam surface 62 along the lower end portions 40 of the ring fingers 24 and biases these lower end portions towards each other, as seen in FIG. 5, so that the upper end portions 28 of the ring fingers move apart to their opened position. After the looseleaf papers have been inserted or removed, the slide bar 18 is pushed in the direction of the arrow A to disengage the cam surfaces 62 with the lower end portions 40 of the ring fingers and to re-engage them with the cam surfaces 64. When the slide bar 18 is fully inserted in its position shown in FIG. 5 the lower end portions 40 are engaged with the flat surface portion 66 of cam member 64 so that the ring fingers are locked in their closed positions. Thus the operation of moving the slide bar 18 is similar to the operation of moving the conventional tab control mechanism on conventional metal ring binders and has the advantage for the user and the manufacturer that the operation is simple and similar to that to which the users are familiar.

Moreover, by the construction of the present invention the two-piece binder assembly while relatively simple, is easily substituted by the manufacturer for the conventional metal binder ring assemblies presently used. The mounting arrangement for the assembly is identical to that used in previously proposed metal binders, but the assembly is substantially simpler in construction and is more economical to manufacture and assemble.

Although an illustrative embodiment of the present invention has been described herein with reference to the accompanying drawing, it is to be understood that the invention is not limited to that precise embodiment thereof, but that various changes and modifications may be effected therein by one skilled in the art without department from the scope or spirit of this invention.

What is claimed is:

1. A looseleaf binder ring assembly comprising a one-piece backbone formed of a resilient plastic material; said backbone having a bight portion defining upper and lower surfaces, a plurality of apertures formed in its bight portion, and a plurality of pairs of cooperating fingers formed integrally therewith and extending through said apertures, the fingers of each pair facing one another and being pivotally connected to the backbone by integral flexible webs; said fingers having upper looseleaf holding portions extending from said opening above the upper surface of the backbone and lower end portions extending generally vertically downwardly through said openings to positions below said lower surface; said fingers being pivotable between open and closed positions of said looseleaf holding portions, a relatively flat slide bar slidably mounted for movement between first and second positions with respect to said backbone, said positions corresponding respectively to the open and closed positions of said fingers; said slide bar having a plurality of finger moving members formed integrally therewith and respectively associated with the lower end of each of said fingers; said finger moving members each having an upwardly opening recess formed therein and generally diagonally opposed cam surfaces on opposite sides of the recesses in substantially the same horizontal plane with respect to the generally vertically extending lower end portions of their associated fingers, said cam surfaces extending angularly in said horizontal plane with respect to the direction of sliding movement of said bar; said lower end portions of said fingers extending into said recesses and with opposite sides thereof being respectively engaged by the generally diagonally opposed cam surfaces associated therewith in the first and second positions of the slide bar, one of said cam surfaces engaging one side of its associated finger and holding it in its open position when the side bar is in its first position and the other of said cam surfaces engaging another side of its associated finger and holding it in its closed position when said slide bar is in its second position

2. The looseleaf binder as defined in claim 1 wherein said other of said cam surfaces has an inclined cam section which initially engages the lower end portion of its associated finger as the slide bar is moved from its first to its second position and a trailing straight flat section extending parallel to the direction of sliding movement for firmly locking said fingers in their closed positions.

3. The looseleaf binder as defined in claim 1 wherein said backbone has an inverted U-shaped configuration in section and a plurality of inwardly directed flanges formed on the free ends of the legs of its U-shaped configuration, said slide bar being retained in said backbone by said flanges between the flanges and the lower surface of the backbone.

4. The looseleaf binder as defined in claim 3 wherein said finger moving members have edge portions which overlie and mate with said flanges whereby said slide bar is slidable on the flanges in the backbone and is guided during sliding movement between said first and second positions.

5. The looseleaf binder as defined in claim 3 wherein said slide bar has at least one pair of longitudinally spaced slots formed therein and said backbone has a pair of mounting posts extending downwardly therefrom through said slots for mounting the binder assembly to a binder cover without interfering with sliding movement of the slide bar.

6. The looseleaf binder as defined in claim 5 wherein at least one of said slots limits sliding movement of the slide bar with respect to the backbone by the engagement of an edge thereof with its associated post to define one of the positions of the slide bar.

7. The looseleaf binder as defined in claim 6 wherein one of said cam surfaces of at least one pair of diagonally opposed cam surfaces has a shoulder portion for limiting sliding movement of the slide bar in at least one direction to define the other position of the slide bar.

* * * * *